US010583574B2

(12) United States Patent
Vyce

(10) Patent No.: US 10,583,574 B2
(45) Date of Patent: Mar. 10, 2020

(54) INTEGRATED SHAVING MECHANISM

(71) Applicant: J. Richard Vyce, Lexington, MA (US)

(72) Inventor: J. Richard Vyce, Lexington, MA (US)

( * ) Notice: Subject to any disclaimer, the term of this patent is extended or adjusted under 35 U.S.C. 154(b) by 0 days.

(21) Appl. No.: 15/791,078

(22) Filed: Oct. 23, 2017

(65) Prior Publication Data

US 2018/0141227 A1 May 24, 2018

Related U.S. Application Data

(60) Provisional application No. 62/411,811, filed on Oct. 24, 2016.

(51) Int. Cl.
*B26B 19/14* (2006.01)
*B26B 25/00* (2006.01)
*B26B 19/04* (2006.01)

(52) U.S. Cl.
CPC ..... *B26B 19/145* (2013.01); *B26B 19/046* (2013.01); *B26B 25/002* (2013.01)

(58) Field of Classification Search
CPC ... B26B 25/002; B26B 19/046; B26B 19/145; B26B 19/04; B26B 19/10; B26B 19/12; B26B 19/14; B26B 19/141; B26B 19/143
USPC ..... 30/43.4–43.92, 42, 44, 45
See application file for complete search history.

(56) References Cited

U.S. PATENT DOCUMENTS 2,598,292 A 5/1952 O'Russa
3,704,518 A * 12/1972 Heyek ..... B26B 19/04 30/34.1
3,893,236 A * 7/1975 Nissen ..... B26B 19/384 30/346.51
4,170,822 A * 10/1979 Groothuis ..... B26B 19/044 30/346.51
4,292,737 A * 10/1981 Packham ..... B26B 19/04 30/43.92
4,578,861 A * 4/1986 Schweingruber ..... B26B 19/04 30/346.51
5,231,760 A * 8/1993 Koster ..... B26B 19/28 30/43
5,377,414 A 1/1995 Buzzi et al.
5,532,024 A 2/1996 Arndt et al.
(Continued)

*Primary Examiner* — Phong H Nguyen
(74) *Attorney, Agent, or Firm* — Hamilton, Brook, Smith & Reynolds, P.C.

(57) ABSTRACT

An integrated shaving mechanism (ISM) comprises a 28- x 50-mm perforated arbor of 40-mm cylindrical radius supporting a 50-μm 300-mg inverted-headfoil-like cutterfoil with a 25×40-mm cutting pattern, held slideably under an attached complementary-patterned headfoil. Arbor, cutterfoil, and headfoil provide a few-mm thick shaving mechanism coupled to a shaver body having a motor and eccentric drive shaft that in minor design variations scans the cutterfoil either ±1-mm in reciprocation (R-ISM) or 1-mm-R in circulation (C-ISM) at 0.16K-cpm. With its 10-cm$^2$ area of 0.7-mm-spaced cutting edges capable of firm facial contact, it cuts short hairs at up to 10× the rate of conventional shavers for fast closest-cutting. Arbor-supported cutterfoils and headfoils can be fabricated as thin and lightweight monolayers and multilayers of hard materials and coatings by mechanical and non-mechanical processes. ISMs can be embodied in the size and shape of reciprocator and rotary shavers.

11 Claims, 3 Drawing Sheets

(56) References Cited

U.S. PATENT DOCUMENTS

| | | | | |
|---|---|---|---|---|
| 7,024,775 | B2 * | 4/2006 | Uchiyama | B26B 19/04 30/346.51 |
| 2006/0143924 | A1 * | 7/2006 | Mercurio | B26B 19/04 30/43.91 |

* cited by examiner

INTEGRATED SHAVING MECHANISM

RELATED APPLICATIONS

This application claims the benefit of U.S. Provisional Application No. 62/411,811, filed on Oct. 24, 2016. The entire teachings of the above application are incorporated herein by reference.

BACKGROUND

Headfoil-type shavers typically have dual 9-12-mm-D cylindrical bladed or perforated cutters reciprocated ±1-mm axially against headfoils at 8K-cpm as part of 3-6-g cutting mechanisms with effective cutting areas of under 3-$cm^2$, while a few faster models have inversely less. Rotary shavers have 2-3 narrow flat circular cutting areas, partially compensated by higher cutter scan velocity.

Shaver mechanism designs have changed little and performance has improved minimally since headfoils of current thinness were developed decades ago. Basic designs are over a half-century old, and many old designs still being sold shave as well as new ones.

SUMMARY

An embodiment of the present invention is an integrated shaving mechanism (ISM) that comprises a 28- ×50-mm perforated arbor of 40-mm cylindrical radius supporting a 50-μm 300-mg inverted-headfoil-like cutterfoil with a 25×40-mm cutting pattern, held slideably under an attached complementary-patterned headfoil. The arbor, cutterfoil, and headfoil provide a few-mm thick shaving mechanism coupled to a shaver body having a motor and eccentric drive shaft that in minor design variations scans the cutterfoil either ±1-mm in reciprocation (R-ISM) or 1-mm-R in circulation (C-ISM) at 0.16K-cpm. With its 10-$cm^2$ area of 0.7-mm-spaced cutting edges capable of firm facial contact, it cuts short hairs at up to 10× the rate of conventional shavers for fast closest-cutting. Arbor-supported cutterfoils and headfoils can be fabricated as thin and lightweight monolayers and multilayers of hard materials and coatings by mechanical and non-mechanical processes. ISMs can be embodied in the size and shape of reciprocator and rotary shavers.

Before providing a summary of additional example embodiments of the invention, a brief description of the process used to arrive at the disclosed example embodiments is provided.

Conventional shaver shortcomings of slow shaving with incomplete cutting and irritation from the numerous sweeps required are alleviated by the faster, closer-cutting of example embodiments of the smoothly-surfaced large-area integrated shaving mechanisms (ISMs) disclosed herein.

ISM Configurations' Evolution

Encircling Cutterfoil (C-EISM) Configurations

Initial experiments aimed at improving shaver performance were directed at reducing cutter vibration to allow higher frequency scanning. These, involving reconfigurations and counterbalancing of conventional shaver mechanisms and cutters, proved unsuccessful, due to inability to significantly reduce the >1-gram weight of their scanned components.

Continuing conception and testing of novel concepts for improved shaver cutting led to scanning tests on a 12-mm diameter chromed shaft, referred to herein as an "arbor," of an encircling brass shim tube 50-μm thick ×50-mm long fitted with a small drive bearing. Exhibiting negligible vibration when circulated in a 1-mm radius at >20K-cpm by an overvolted shaver motor, this suggested replacing the shim stock with an equally thin shaver headfoil as a cutterfoil, inverted to hold its cutting surface against that of a superposed headfoil. A Braun 428 headfoil of 55-μm×48-mm long×44-mm wide and weighing <400-mg encircled the shaft with overlap for bonding. When inverted in shaving configuration under a normal Braun 420U headfoil in its housing, FIG. 5, it circulated smoothly at >20K-cpm and cut facial hair in short segments, limited by the solid arbor.

Shaving models of this EISM cutting configuration constructed on various shaver bodies utilized 12-mm diameter low-friction Delrin arbors with narrow circumferential bearing lands spaced 6-mm and cutouts for uncut hairs and clipping (i.e., clipped hair) passage. Cutterfoils of various makes driven by 1.2-v shaver motors over-volted 2× by two 1.5-v AA cells were circulated and reciprocated at >16K-cpm, twice typical shaver scan frequency. Cutting with various headfoils under normal shaving facial pressure, their rapidly-scanning, closely-spaced, cutting edges shaved faster and closer than the best conventional shavers.

Large Area Cutterfoil ISM Configurations

Encircling cutterfoil models proved ISM shaving superiority, but their 6-mm radius cylindrical cutting surface makes firm close-cutting facial contact over <3-$cm^2$ of the Braun 428 cutterfoil's 10-$cm^2$ cutting area, full use of which would greatly increase shaving speed.

Although a dual-cutter C-EIMS could double cutting area, a concept for achieving the full 10-$cm^2$ potential was to fit the foils on a typical shaver-head-sized 28×50-mm×40-mm radius cylindrical-segment arbor in the ISM configuration of FIGS. 1-4B. But, the thin cutterfoil's larger area, confined only by the headfoil, raised risk issues of its survivability under the required higher driving force, and, to avoid the complication of spring pressurization, of facial pressure adequacy for effective cutting. Cutterfoil survivability was initially demonstrated by scanning a 45- ×27-mm 300-mg trimmed Braun 428 headfoil under a finger-pressurized Braun 420U at ±1-mm up to 24K-cpm, and later by long shaving life of this foil combination at >16K-cpm. Cutting effectiveness was demonstrated by excellent shaving with normal shaving facial pressure on initially lightly-contacting foils. Observations by testers included the shortness of beard regrowth the next morning.

This ISM configuration was also tested in reciprocator and circulator models with a 40-mm radius Delrin arbor using available large foils (Braun, Panasonic, Grundig) with the headfoils bonded to the arbor edges. The Braun 428 and 420U foil combination proved superior and has been used in all advanced models.

Reciprocating ISM (R-ISM)

The Braun 428 cutterfoil in the reciprocating R-ISM embodiment, FIGS. 1-4, has its cutting pattern rows superimposed on those of the Braun 420U headfoil and is scanned by a shaver motor eccentric shaft through a bonded-on slotted drive bearing incorporating narrow axial-scan-alignment arms running in an arbor groove. The Delrin arbor has an open pattern of cutterfoil-bearing webs whose openings serve as clipping passages.

Near-product-quality R-ISM design has a 4-mm thick ISM bonded to a shortened detachable head of a Payer/Wahl 39.0 or Optimus 50046S shaver with their mechanisms removed, the cutterfoil driven directly ±1-mm at 16K-cpm by a raised replacement Mabuchi FF180 SH 1.2-v motor with a 1-mm-r stroke eccentric powered at 2.4-v by two replacement Nimh AA-cells. This design shaves more completely, closer, and substantially faster than conventional shavers.

Circulating ISM (C-ISM) Configuration Perspective

A circulating C-ISM differs minimally from the R-ISM in using a holed drive bearing, with alignment pads centered near the cutterfoil ends running in 2-mm wider arbor grooves, providing 1-mm radius non-rotating scan circulation with aperture rows superposed. While early R-ISM and C-ISM models of the same dimensions shaved comparably with the Braun foils, proving the C-ISM's effectiveness for later applications, R-ISMs are somewhat easier to construct so have been used in most subsequent test models, since their performance also validates C-ISM potential.

Braun Foil Application

The utility and fast close-cutting performance of the Braun 428 as cutterfoil paired with a Braun 420U headfoil, both 44- ×48-mm, benefit from their complementary characteristics. Their aperture rows have identical lateral pitch that allows their superposition, minimizing aperture obstruction by webs and cutting-ridge clashing. Their axial pitches differ slightly, observed as several moires between them, which produce multiple small cutting loads throughout a scan cycle instead of a single peak. Although their apertures of about the same size differ in shape, this is apparently uncritical as evidenced by their good cutting and that of other foil combinations more mis-matched than the Brauns'. The essential factor is the closely-spaced cutterfoil web cutting edges rapidly scanning like thin blades across the large area of headfoil apertures.

While the 420U foil has a full 44- ×44-mm cutting area, the 428's is fortuitously 25- ×40-mm edged by finely perforated bands. Narrow widths of these are left as continuous protection for its more vulnerable larger cutter apertures when trimmed to 26.5-mm wide for close edge-cutting, and 45-mm long to remain under the 420 ends when scanning, both on a 28- ×50-mm arbor bonded to a Payer or Optimus headfoil cover with one edge overhanging.

Less conveniently, both foils' aperture rows are angled 7°-CW, crossing at 14° with the cutterfoil inverted, requiring oppositely orienting them to superpose their rows. But cutterfoil rotation is disallowed by need for its protected edges to be parallel with the rectangular arbor's, leaving its rows and scan direction at 7°-CW. This requires awkward, but practicable, headfoil rotation of 14°-CW and some end-trimming on ISM models, and is easily eliminated for custom ISM designs. Optimal axially-scanned head- and cutterfoil aperture patterns for R-ISM products are likely to differ from the Brauns'.

Shaving Speed and Closeness

Multi-year development of progressively improved ISMs allowed qualitatively comparing performance of various foil combinations, alignments, and scan patterns, identifying the Braun 428-420U as the most effective. But design guidance for comparison with conventional shavers called for quantitative explanation of close-cutting.

A shaver-shaved beard is not the typically depicted array of uniformly closest-cut hairs, but one of random heights, because a single cutter scan closest-cuts only a miniscule fraction of hairs, so even numerous sweeps and long shaving time leave many only partially cut, the number and lengths of which determine the shave's perceived closeness and next-morning stubble.

All shavers with similar headfoil thicknesses are ultimately capable of comparable closest-cutting. This requires the headfoil to be firmly pressed on the skin, and a cutting edge shearing a 50-100-μm diameter hair just when it is at a headfoil aperture edge in the cutter scan direction. But conventional shaver headfoil 500-μm apertures are 5-10X-hair diameter, and 1250-μm cutting edge spacings 12-25×, so a sweeping shaver has extremely low probability of both a hair and a scanning cutting edge being simultaneously at a headfoil aperture cutting edge. Thus, most hairs are cut when bent-over to an edge, and only partially shortened, or nibbled, and this produces most of the encouraging but misleading cutting noise. Nibbling occurs repeatedly for most hairs, which fail to be closest-cut even after numerous sweeps within acceptable shaving time or tolerable facial irritation. Their greater length produces a feeling of roughness relative to the smoothness when all are closest-cut, and their re-growth is noticeably sooner, producing earlier 5-o'clock shadow. So, getting a close shave fast, with few sweeps, calls for an extremely high cutting rate to increase the probability of close-cutting in each scan and sweep. This requires facial contact by numerous apertures and cutting edges, available from larger headfoil and cutter areas with more closely-spaced cutting edges, and from the cutter's scanning at high frequency.

The ISM, FIGS. 1-4B, cutterfoil's 10-$cm^2$ effective cutting area, its closely spaced cutting edges, and its higher scanning frequency are ~3×, 2×, and 2× those of typical shavers, providing >10× higher cutting rate. This allows closest-cut shaving in 2±-minutes, approaching that of a razor, and more comfortably from the smooth cutting surface and few sweeps required.

Example Embodiments Summary

In view of the foregoing, a summary of example embodiments of the invention follows.

An Arbor-based Integrated Shaving Mechanism

An example embodiment of the present invention includes an arbor for a shaver. The arbor includes a body of firm material in shaver head shape incorporating means for attaching a headfoil. The body has a lower portion with means for coupling to a shaver body. The arbor also includes an upper surface with the shape of a desired cutting surface, with support bearing and alignment means for supporting the cutting surface form. The embodiment also includes a shaver cutterfoil, held in contact with the body of the arbor by an attached headfoil movably in a cutting motion, having upper cutting means for cutting short hairs cooperatively with the headfoil, and lower drive bearing and complementary alignment means that allow the shaver cutterfoil to be driven in the cutting motion against the headfoil, their interface constituting a cutting surface, the shaver cutterfoil and headfoil each being a cutting element. The arbor has openings allowing entry of hairs through the cutting elements for cutting, and for passage of cut hairs, whereby, the arbor fitted with the shaver cutterfoil and headfoil forms an integrated shaving mechanism capable of close-cutting short hairs when attached to a compatible shaver body having a suitably powered drive motor and eccentric shaft driving the shaver cutterfoil.

Monolayer Cutterfoil for Integrated Shaver Mechanism

Another embodiment of the present invention includes a monolayer cutterfoil for a shaver. The monolayer cutterfoil comprises a thin foil of material suitable for a shaver cutter of large area and lightweight that has apertures with upper surface cutting edges in a closely spaced pattern complementary to those of a headfoil, together suitable for cutting short hairs when arranged in contact as a cutting surface (i.e., the cutterfoil and headfoil combination defines a cutting surface) and when the cutterfoil is driven in a cutting motion. The monolayer cutterfoil further comprises a lower surface bearing and alignment means for support in cutting-surface form and movably in a cutting motion on an arbor with complementary bearing and alignment means. The embodiment further comprises a drive bearing means for engaging a drive means for driving the thin foil in the cutting motion, thereby forming a monolayer cutterfoil. When fitted on an arbor, such as an arbor as described above, in movable contact with a headfoil attached to the arbor, the headfoil, monolayer cutterfoil, and arbor form an integrated shaver mechanism, the monolayer serving as a cutter of large cutting area that is lightweight and capable of being driven in the cutting motion for cutting short hair at high frequency with low vibration.

A Rigid Cutterfoil for an Integrated Shaver Mechanism

Another embodiment of the present invention is a rigid cutterfoil for an integrated shaver mechanism. The rigid cutterfoil comprises a cutterfoil as described above, affixed to a rigid open lightweight support structure of upper cutting surface form. The rigid cutterfoil includes a lower surface bearing and alignment means for support movably in a cutting motion by the arbor with complementary bearing and alignment means. The embodiment further includes a drive bearing means for engaging a drive means for driving the foil in the cutting motion, thereby forming the rigid cutterfoil, whereby, when fitted on an arbor, such as the arbor described above, in movable contact with a headfoil attached to the arbor, the rigid cutterfoil and arbor form an integrated shaver mechanism, the rigid cutterfoil serving as a cutter of large cutting area and lightweight capable of being driven in the cutting motion for cutting short hair at high frequency with low vibration.

Another embodiment of the present invention is a rigid cutterfoil for a conventional shaver. The rigid cutterfoil as described above is affixed to a rigid, open, lightweight, support structure of upper cutting surface form. The rigid cutterfoil further includes a lower surface means for attachment to a conventional shaver cutter support and drive mechanism, thereby forming a rigid cutterfoil for a shaver. When attached to the cutter support and drive mechanism and thereby supported in movable contact with a conventionally associated headfoil, the rigid cutterfoil serves as a cutter capable of large cutting area and lightweight and of being driven in the cutting motion at high frequency with low vibration.

Another embodiment of the present invention is a multilayer cutterfoil for a shaver. The multilayer cutterfoil includes a cutterfoil, such as described above, with the thin foil replaced by a multilayer foil. The multilayer cutterfoil includes a substrate of lightweight material embodying the lower surface bearing, alignment, and drive bearing means, an upper surface thin layer of material suitable for a shaver cutter deposited or affixed on the substrate, both having through apertures with upper surface cutting edges in a closely spaced pattern complementary to those of a headfoil, thereby forming a multilayer cutterfoil. When fitted on an arbor, such as the arbor described above, in movable contact with the headfoil attached to the arbor thereby forming an integrated shaver mechanism, the multilayer cutterfoil serves as a cutter of large cutting area and lightweight capable of being driven in the cutting motion for cutting short hair at high frequency with low vibration.

An ISM with a Rigid Cutterfoil

Another embodiment of the present invention is a rigid cutterfoil for an integrated shaver mechanism. The rigid cutterfoil comprises a cutterfoil as described above, affixed to a rigid, open, lightweight support structure of upper cutting surface form. The rigid cutterfoil includes lower surface bearing and alignment means for support movably in a cutting motion by an arbor, such as an arbor described above, with complementary bearing and alignment means, and drive bearing means for engaging a drive means for driving the foil in the cutting motion, thereby forming a rigid cutterfoil. When fitted on the arbor movably in contact with the headfoil attached to the arbor, the rigid cutterfoil and arbor form an integrated shaver mechanism, the rigid cutterfoil serving as a cutter of large cutting area and lightweight capable of being driven in the cutting motion for cutting short hair at high frequency with low vibration.

Rigid Cutterfoil for a Conventional Shaver

Another embodiment of the invention is a rigid cutterfoil for a conventional shaver. The rigid cutterfoil as described above is affixed to a rigid, open, lightweight, support structure of upper cutting surface form. The rigid cutterfoil further includes a lower surface means for attachment to a conventional shaver cutter support and drive mechanism, thereby forming a rigid cutterfoil for a shaver. When attached to the cutter support and drive mechanism and thereby supported in movable contact with a conventionally associated headfoil, the rigid cutterfoil serves as a cutter capable of large cutting area and lightweight and of being driven in the cutting motion at high frequency with low vibration.

Another embodiment of the present invention includes an integrated shaving mechanism (ISM), comprising an arbor; a headfoil attached to the arbor; and, holding movably on the arbor, a complementary lightweight cutterfoil movably associated with the headfoil in a manner enabling a cooperative cutting motion. The arbor, headfoil, and cutterfoil constitute the integrated shaving mechanism (ISM). The embodiment may further include a shaver driving means coupled to the ISM to drive the cutterfoil in a cutting motion relative to the headfoil in a motion capable of cutting short hairs.

Another embodiment of the present invention is an integrated shaver. The integrated shaver includes: an integrated shaving mechanism (ISM), such as the ISM described above, with means for coupling to a shaver body having complementary coupling means, a high frequency cutterfoil drive means, drive power means, and a drive motor with a drive eccentric, the drive eccentric engaging a cutterfoil drive bearing to drive the cutterfoil in the cutting motion in contact with the headfoil. The ISM coupled to the shaver body constitutes an integrated shaver capable of cutting short hairs at high frequency with low vibration.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

A description of example embodiments follows.

The teachings of all patents, published applications and references cited herein are incorporated by reference in their entirety.

Cutterfoil Integrated Shaving Mechanism Detailed Descriptions

This specification and detailed descriptions are based on experience building and shaving with cutterfoil shaver models made using home workshop resources, but the claimed invention allows a wide range of variations and advances, the general directions of which are given under Options, below, identification of whose most desirable versions depends on implementation details.

Reciprocating R-ISM: FIGS. 1-4B

FIG. 1: top view

Figure 1:
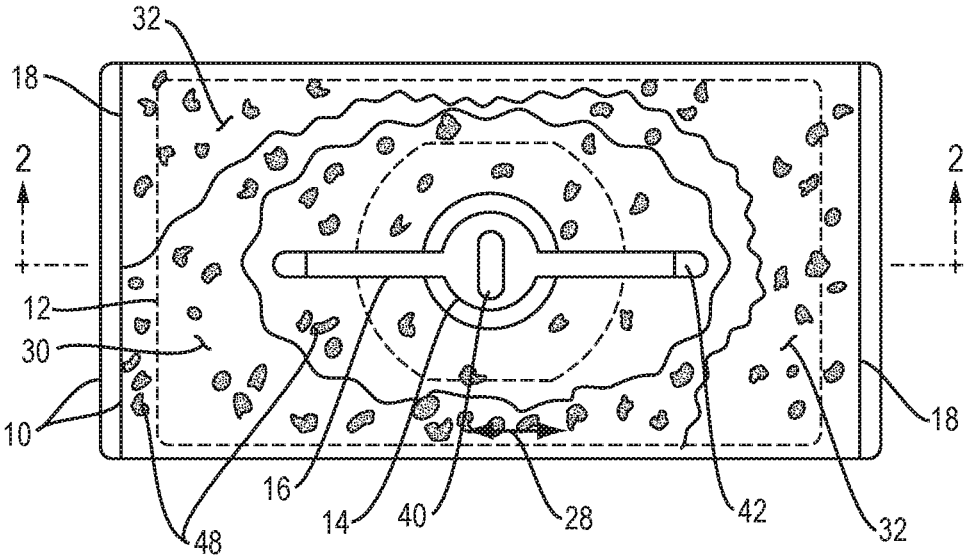
FIG. 1 is top view of an integrated shaving mechanism (ISM)
Figure 2:
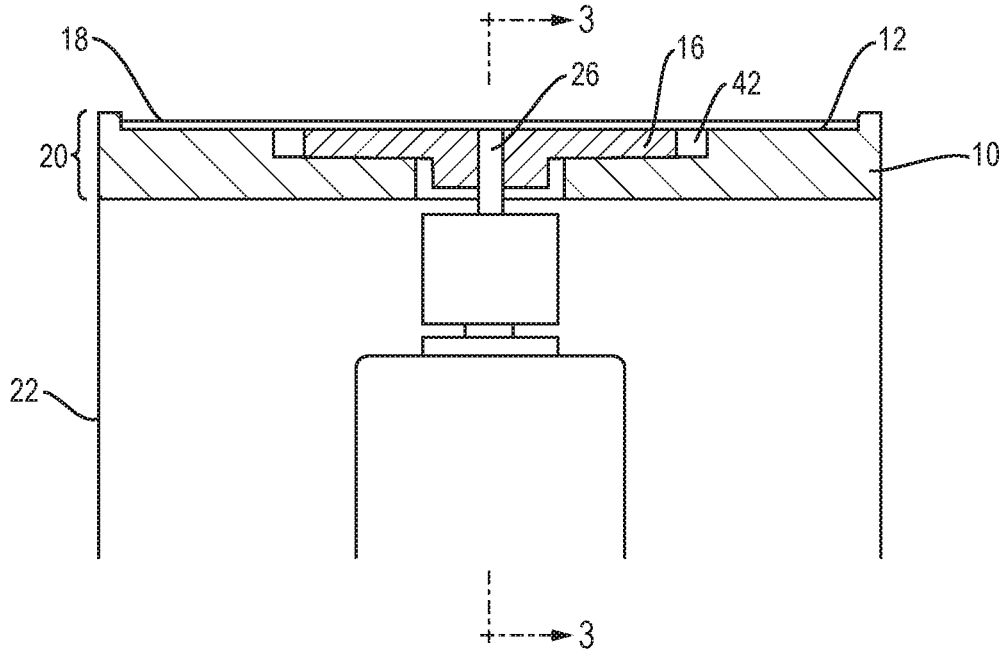
FIG. 2 is a side cross-sectional view 2-2 of FIG. 1.

FIG. 2: side cross-section 2-2 of FIG. 1

Figure 3:
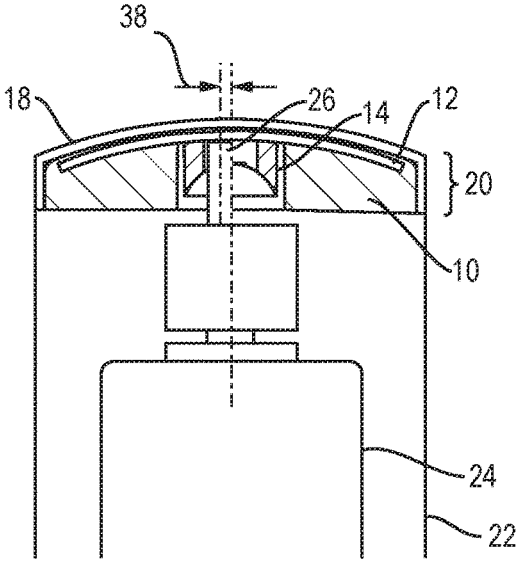
FIG. 3 is an end cross-sectional view 3-3 of FIG. 2.

FIG. 3: end cross-section 3-3 of FIG. 2

Figure 4A:
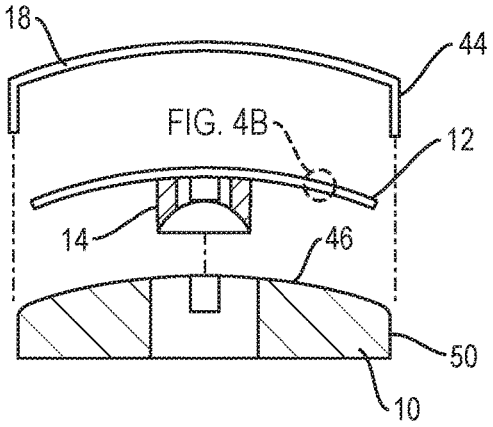
FIG. 4A and 4B are an exploded view of components of FIG. 3 separated from each other.
Figure 4B:
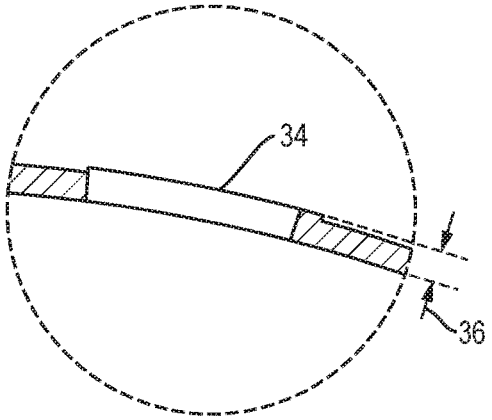

FIG. 4A and 4B: components of FIG. 3, separated

Figure 5:
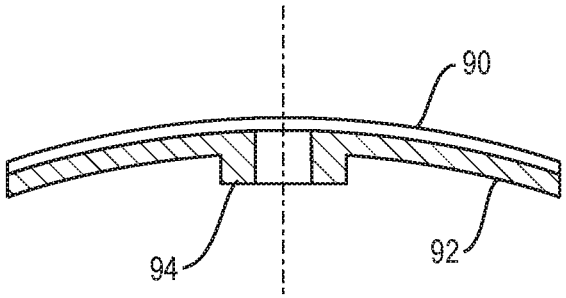
FIG. 5 is a side view of a multilayer cutterfoil and headfoil embodiment.

FIG. 5: multilayer cutterfoil and headfoil combination

Figure 6:
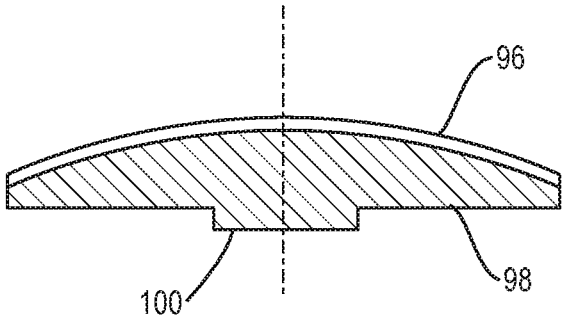
FIG. 6 is a side view of a rigid cutterfoil embodiment.

FIG. 6: rigid cutterfoil

Parts Callouts: FIGS. 1-6:

10 arbor
12 cutterfoil
14 drive bearing
16 alignment arms
18 headfoil
20 modular shaver mechanism
22 shaver body
24 drive motor
26 eccentric shaft
28 cutterfoil scan axial reciprocation
30 cutterfoil aperture pattern
32 headfoil aperture pattern
34 cutterfoil cutting edge ridges
36 cutterfoil thickness
38 eccentric radius
40 bearing slot
42 alignment grooves
44 headfoil edges
46 arbor bearing surface
48 arbor bearing web and clipping passage pattern
50 arbor edges
90 cutterfoil cutter layer
92 open-patterned substrate
94 bearing and alignment elements
96 cutterfoil cutter layer
98 rigid lightweight substrate
100 bearing and alignment elements R-ISM Embodiment The R-ISM mechanism, FIGS. 1-4B, comprises a fixed arbor 10, an inverted Braun 428 cutterfoil 12, with affixed drive bearing 14 incorporating a lateral bearing slot 40 and alignment arms 16, that is axially 28 movable on the arbor guided by the alignment arms 16 in alignment grooves 42. A Braun 420U headfoil 18 is attached via headfoil edges 44 to the arbor 10 at arbor edges 59 and contacts an arbor bearing surface 46, confining the cutterfoil 12 in movable contact and integrating all as an ISM 20. This attaches to a shaver body 22 housing a powered drive motor with shaft 26 of 1-mm eccentricity engaging 24 the drive bearing, together producing the cutterfoil ±1-mm cutting scan 38 axial reciprocation 28.

Optionally attaching the motor to the arbor provides a modular ISM (M-ISM) alternative when mounted on an appropriate shaver body with a suitable power supply.

Cutterfoil and headfoil are Braun shaver electroform foils 55-μm thick 36 with 40-μm bodies and 15-μm high cutting edge ridges 34. The cutterfoil has a Braun 428 headfoil aperture pattern 30, its aperture rows and narrow guard bands and the alignment elements 16, 42 aligned axially 28, its ridged 34 cutter surface facing up, and is trimmed shorter than the headfoil to remain under it when scanned. The headfoil has a Braun 420U aperture pattern 32, also axially aligned and laterally phased to superpose their aperture rows.

The arbor is of Delrin, 28×50-mm with a 40-mm radius bearing surface 46 comprising narrow bearing webs 48 congruent with headfoil apertures in an open pattern covering, in one embodiment, every sixth axial headfoil row, and every twelfth lateral column, the openings comprising clipping passages.

C-ISM Embodiment

The circulating C-ISM mechanism, not shown, is similar to the R-ISM of FIGS. 1-4B, with a holed instead of slotted drive bearing to provide cutterfoil ±1-R-mm circular scan motion. Its arbor-conforming cutterfoil bonding area is enlarged laterally to spread lateral drive force over larger cutterfoil area, and it has alignment pads centered near the cutterfoil ends running in 2-mm wider arbor grooves, its arbor and headfoil widths increased to provide clearance for the lateral scan. This positively limits cutterfoil rotation at lateral extremes, with intermediate jitter found to be negligible in shaving and under observation with a high frequency stroboscope and variable pressure on the headfoil.

Multilayer Cutterfoil and Headfoil Options: FIG. 5

A multilayer cutterfoil for an ISM comprises a cutterfoil cutter layer 90 with an affixed or coated low-friction, thin, lightweight, open-patterned substrate 92, with integral or affixed bearing and alignment elements 94 for use in any ISM configuration similar to a monolayer cutterfoil.

Rigid Cutterfoil: FIG. 6

A rigid cutterfoil may comprise a cutterfoil cutter layer 96 affixed to or coated on a rigid lightweight substrate 98 with integral or affixed lower surface bearing and alignment elements 100 for scanning on an arbor, or elements for attaching to a conventional shaver cutter-supporting and scan-drive mechanism.

Drive Bearing Bonding

Drive bearing and alignment elements, usually made in one piece from Delrin sheet, were attached to ISM model nickel electroform cutterfoils using standard super-glues, but occasional bond failures in shaving tests called for improvement. An Internet search revealed IBM U.S. Pat. No. 5,532,024 for a simple "Method for improving the adhesion of polymetric adhesives to nickel surfaces" that provides reliable bonds to nickel electroform foils. Cutterfoils of other materials or coatings, and other bondants can also avoid this problem.

Integrated Shaver Mechanism Options

Generalized ISM Example Embodiment

Conceived and implemented as an ISM using cutterfoils made from shaver headfoils, enabling large lightweight cutters capable of being scanned at high frequency and little vibration, an example embodiment generalized ISM comprises a low friction arbor proximate to a desired cutting surface, supporting a scanning cutterfoil against a headfoil connected to the arbor as an integrated mechanism. Its basic configuration is beneficial economically and dynamically in obviating all static and moving parts other than the arbor, cutter, and headfoil.

The arbor is useful in shaping and supporting extremely thin cutters under shaving pressure, with no added moving mass and little friction, while its benefits are applicable also to any flexible or rigid lightweight cutters with interfaces cooperatively configured for support and efficient scanning.

ISM versions described above are based on concept-proof and performance-test models that, despite being limited by use of available shaver parts and simple tools, set new standards of shaver capability. But, they exploit only a few of the options in design, materials, and fabrication that may be employed in various embodiments of the ISM, where some options are listed below.

C-ISM Relevance to Known Shaver Types

Most ISM models, like most commercial shavers, have been reciprocating R-ISMs for their simplicity and robustness achievable from available model-making tools, commercial headfoils adaptable as cutters, shaver bodies, motors, and power supplies. Their designs, operation and superior performance are readily relatable to conventional reciprocating shavers.

Enough circulating C-ISMs have also been tested to prove their performance and particularly their direct relation to R-ISMs, allowing deriving any new C-ISM technical guidance from relevant R-ISM model characteristics in lieu of dedicated C-ISM models.

Since no circulating shavers are known to have been marketed, the potential for a high performance circulator is indeterminate, so the C-ISM can provide the first widespread test of its desirability.

Advanced Cutterfoil Perspective

The ISM and cutterfoil embodiments establish a new shaver-cutter paradigm of considerably wider scope than current computer-lithographically defined, electro-chemically deposited, 50-μm, headfoil-based cutterfoils used in today's shaver models. Whereas typical shaver cutters are mechanically fabricated multi-part rigid assemblies, the one-piece, non-mechanically fabricated, flexible cutterfoil embodiment disclosed herein encompasses diverse design and fabrication options, including aperture patterns defined by optical or electronic micro-imaging, and fabrication as a monolayer or multilayer foil of various thicknesses by processes such as deposition, coating, erosion, 3-D printing etc.

These fabrication options allow making cutterfoils and headfoils of a wide range of materials with any aperture patterns, of any form, that may offer superior acquisition and close-cutting of hairs in each sweep. Prospective cutterfoil and headfoil materials and coatings alternative to conventional metals, such as crystalline materials, silicon carbide, diamond, sapphire, and graphene, variously offer low friction, low wear for maintaining edge sharpness, and fabrication as monolayer cutters or multilayers of thin cutter coatings on lightweight substrate materials.

Arbor Options

The Delrin arbor for the R- and C-ISM, FIGS. 1-4B, serves well as low friction support and shaper for the thin and flexible cutterfoil and headfoil. A benefit of this monolithic arbor's uniform foil support and direct coupling to shaver structure is enhancement of scanning smoothness by minimizing foilcutter vibration and extraneous motion. Possible refinements include lower friction material or coating, and a web pattern designed to facilitate cutting by the cutting foils.

A foil-like monolayer or multilayer foilcutter on this arbor type is the most advantageous, but more conventional cutters can also benefit in similar ways from arbors combining support and alignment, particularly in allowing thin cutters and obviating other moving elements.

Broader Potential of Arbor-Based ISM

Cutting-Head Shape Options

The ISM cutting head, FIGS. 1-4B, can be made with laterally varied cylindrical radii and with other forms including spherical and toroidal.

The R- and C-ISM headfoil, cutterfoil, and arbor can be made with open-edge cutting apertures, similar to the rigid-comb cutting heads on reciprocating and rotary shavers, allowing unimpeded entry and immediate cutting of long hairs.

Alternatively, long hairs can be acquired quickly for cutting by increasing cutterfoil and headfoil web spacings near cutting head lateral edges.

The 28×50-mm ISM cutting head size and rectangular shape, set by the trimmed Braun 428 cutterfoil, is similar to typical reciprocating shavers, and has been effective and comfortable in test models. But the ISM unitary cutterfoil allows making heads in other sizes and shapes including rounded and triangular, as reciprocators and circulators, and with one or more edges overhanging a smaller shaver head.

Full Area C-ISM and R-ISM

Both Braun-foil-based ISMs provide somewhat larger effective cutting area than conventional reciprocators along with closer cutting-edge spacing and higher cutter scan frequency to achieve significantly higher hair-cutting rate and closeness. Similarly, the C-ISM offers the basis for circulating shavers superior to rotary shavers, with its far larger, cutting-edge-filled, omni-directional cutting area and high cutting frequency.

Adjustable Scan Frequency

ISM high frequency scanning capability permits potentially useful frequency adjustment by changing drive motor frequency such as from 8K-cpm at the start of a shave when the cutting load is greatest, to 16K when the highest cutting rate is desirable for fastest close-cutting.

Replaceable and Separable ISM Module

ISM simplicity and low cost of its parts makes bonded modular cutting head replacement economically feasible, while separable versions allow individual foil replacement if economically desirable.

Rigid Cutterfoil, FIG. 6, for Conventional Shaver Mechanisms

A cutterfoil on a rigid lightweight substrate can replace the multi-part assembled cutters in conventional shavers, where they offer improved cutting, a wider range of cutter aperture sizes and patterns, smoother head forms, lighter weight, and lower cost. Their lower weight allows a larger area cutter and higher frequency scanning with less vibration.

Arbor for Conventional Shaving Mechanisms

The low-friction arbor can support multi-bladed rigid cutters similarly to rigid foilcutters under a shaving-pressurized headfoil and directly connected to a drive motor, obviating a conventional spring-pressurized cutter or headfoil support, and scan mechanisms, thereby reducing the weight and number of moving parts as sources of vibration and cost.

CONCLUSION

It can be seen that the example embodiments of the integrated shaver mechanism and shaver described herein provide a capability for shaving faster, closer, and more comfortably as compared to conventional shavers.

Although the description and examples above contain many specificities, those should not be construed as limiting the scope of the shaver inventions, but as merely providing illustrations of some of example embodiments. Modifications and variations are possible in light of the above teachings, and some of the component features can also be employed to improve the performance and cost of current commercial shavers. Thus, the scope of these integrated shaver mechanism embodiments should be determined by the appended claims and their legal equivalents, rather than by the examples given.

What is claimed is:

1. A shaver, comprising:

a shaver body defining a cavity and an interface end of the cavity;

an arbor having an arbor bearing surface defining a shaver head shape with a profile, the arbor defining an opening and shaver body interface feature, the shaver body interface feature configured to be coupled to the shaver body at the interface end of the cavity with the opening of the arbor aligned with the cavity;

a headfoil coupled to the arbor at edges of the arbor, the headfoil having a skin surface facing side and an arbor facing side, the headfoil having length and width dimensions spanning the opening of the arbor, the headfoil defining an aperture pattern with individual apertures sized to accept a hair projecting from a surface of skin;

a cutterfoil having a headfoil facing side and a cavity facing side, the cutterfoil on the cavity facing side slidably coupled to the arbor bearing surface of the arbor and, on the headfoil facing side, slidably coupled to the arbor facing side of the headfoil in an arrangement enabling a cutting motion of the cutterfoil, the cutterfoil having a length dimension, width dimension, or both, smaller than the respective headfoil length dimension, width dimension, or both, the cutterfoil defining an aperture pattern with individual apertures sized to accept the hair projecting from the surface of the skin, wherein patterns of the apertures of the headfoil and cutterfoil are complementary;

wherein, in the slidably coupled arrangement, the headfoil and cutterfoil have profiles that match the arbor bearing surface profile, and wherein at edges of aligned apertures, the headfoil and cutterfoil define complementary cutting edges capable of cutting respective hair projecting through the aligned individual apertures;

a drive bearing fixedly coupled to the cavity facing side of the cutterfoil;

the arbor, headfoil, and cutterfoil with the drive bearing constituting an integrated shaving mechanism (ISM) with the skin surface facing side of the headfoil being in contact with the skin surface during shaving; and a shaver driving means disposed within the shaver body and coupled to the ISM via the drive bearing to drive the cutterfoil in a cutting motion relative to the headfoil, the shaver driving means capable of driving the cutterfoil, in its arrangement between the headfoil and arbor, at a frequency and force sufficient to cut the respective hair projecting through the aligned apertures, resulting in hair clippings being collected within the cavity of the shaver body.

2. The shaver of claim 1, wherein individual apertures of the headfoil are substantially the same shape as individual apertures of the cutterfoil.

3. The shaver of claim 1, wherein the shaver driving means includes an eccentric drive shaft that is coupled to the ISM via the drive bearing.

4. The shaver of claim 3, wherein the eccentric drive produces a ±1-mm cutting scan of the cutterfoil.

5. The shaver of claim 3, wherein the eccentric drive shaft drives the cutterfoil in a reciprocating scanning motion.

6. The shaver of claim 3, wherein the eccentric drive shaft drives the cutterfoil in a circulating scanning motion.

7. The shaver of claim 1, wherein the shaver driving means is capable of driving configured to drive the cutterfoil up to a frequency of 16K cycles per minute (cpm).

8. The shaver of claim 1, wherein the shaver driving means is configured to drive the cutterfoil between a frequency of 8K-cpm and 16K-cpm.

9. The shaver of claim 1, further comprising an open-patterned substrate, and wherein the cutterfoil is an upper layer of the substrate, wherein the open-patterned substrate includes the drive bearing.

10. The shaver of claim 1, further comprising a substrate, and wherein the cutterfoil is an upper layer of the substrate and the substrate includes the drive bearing.

11. The shaver of claim 1, further comprising a substrate, and wherein the cutterfoil is an upper layer of the substrate and wherein the drive bearing is an interface configured to couple to a conventional shaver cutter support and drive mechanism.

* * * * *